US006357333B1

(12) United States Patent
Vendetti et al.

(10) Patent No.: US 6,357,333 B1
(45) Date of Patent: Mar. 19, 2002

(54) DUAL ADJUSTING OVERRIDE PRECISION SWITCH ACTIVATOR

(75) Inventors: Vincent J. Vendetti, Fredericksburg; Michael M. Canaday, King George, both of VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/480,422

(22) Filed: Jan. 10, 2000

(51) Int. Cl.[7] ..... F41A 19/69

(52) U.S. Cl. ..... 89/125; 89/129.01; 89/136; 200/47

(58) Field of Search ..... 42/84; 200/47, 200/302.2

(56) References Cited

U.S. PATENT DOCUMENTS 2,289,108 A * 7/1942 Eaton
2,347,874 A * 5/1944 Bluemle
2,368,926 A * 2/1945 Jeffrey
2,904,661 A 9/1959 Roeser
3,610,857 A * 10/1971 Nannings
3,982,347 A * 9/1976 Brandl et al.
4,166,939 A * 9/1979 Switzer
4,307,799 A * 12/1981 Zouzoulas
4,362,916 A 12/1982 Anderson
4,556,768 A * 12/1985 Atsumi et al.
5,315,080 A * 5/1994 Kaczynski et al.

* cited by examiner

*Primary Examiner*—Charles T. Jordan
*Assistant Examiner*—Troy Chambers
(74) *Attorney, Agent, or Firm*—James B. Bechtel, Esq.; John P. McMahon, Esq.

(57) ABSTRACT

A switching assembly that operatively cooperates with the triggering mechanism of a firearm, such as a rocket launcher, is disclosed. The switching assembly allows for an adjustable trigger linear travel of about 0.4" within an accuracy of 0.01 inches, while at the same time prevents any over-travel of the switch activator from damaging a depressible switch that is operatively interconnected to firing of the rocket from the launcher.

17 Claims, 2 Drawing Sheets

DUAL ADJUSTING OVERRIDE PRECISION SWITCH ACTIVATOR

ORIGIN OF THE INVENTION

The invention described herein was made in the performance of official duties by an employee of the Department of the Navy and may be manufactured, used, licensed by or for the Government for any governmental purposes without the payment of any royalty thereon or therefor.

FIELD OF THE INVENTION

The present invention relates generally to firearm technology and, more particularly, to an assembly for controlling the triggering action of a firearm, such as rocket launchers.

BACKGROUND OF THE INVENTION

Triggering mechanisms for firearms, such as a rocket launcher, are well known, and need to provide precision activation, while at the same time provide repeatable and reliable operation. One of the parameters of a triggering mechanism that needs to be taken into account is the amount of travel that the trigger encounters during its usage in activating the firearm. For firearms, such as a rocket launcher, it is desirable that the amount of travel be limited to 0.4 or less inches of linear travel.

Triggering mechanisms for firearms, such as a rocket launcher, typically activate a depressible switch, which, in turn, activates the associated elements for the initiation and, then, completion of the firing of the rocket from the associated launcher. A triggering mechanism that experiences overshoot, may damage the depressible switch which, in turn, may negate the operational readiness of the associated firearm. It is desired that means be provided for a triggering mechanism that prevents the damage commonly caused by overshoot of the trigger mechanism.

SUMMARY OF THE INVENTION

Accordingly, it is a primary object of the present invention to provide for a triggering mechanism in which the movement of the trigger is limited to 0.4" of linear travel and is adjustable to within an accuracy of about 0.01".

It is a further object of the present invention to provide means that prevents any damage to a depressible switch that may occur from the over-travelling of an associated trigger switch.

In accordance with these and other objects, the invention provides an assembly interconnected to a trigger mechanism of a firearm that controls the triggering action thereof. The assembly comprises a housing, a sliding actuator, first and second yielding means, a rod, a block mated to the housing, and a depressible switch. The sliding actuator has an interior and is lodged in the housing and has first and second ends with an extension extending outward from the first end. The first yielding means has a first predetermined stiffness and is lodged in the housing and located around the first end of the sliding actuator. The second yielding means has a second predetermined stiffness which is less than the first stiffness and is lodged in the housing and located around the second end of the sliding actuator. The rod has at least first and second sections having respective diameters to pass through the interior of the siding actuator and to come in contact with the first yielding means. The block is located adjacent the extension of the sliding actuator, whereas the depressible switch is located on the block and in alignment with the extension of the sliding actuator.

BRIEF DESCRIPTION OF THE DRAWINGS

The foregoing objects and advantages of the present invention will become more fully understood from the following detailed description and reference to the appended drawings wherein.

DETAILED DESCRIPTION OF THE PREFERRED EMBODIMENTS

Figure 1:
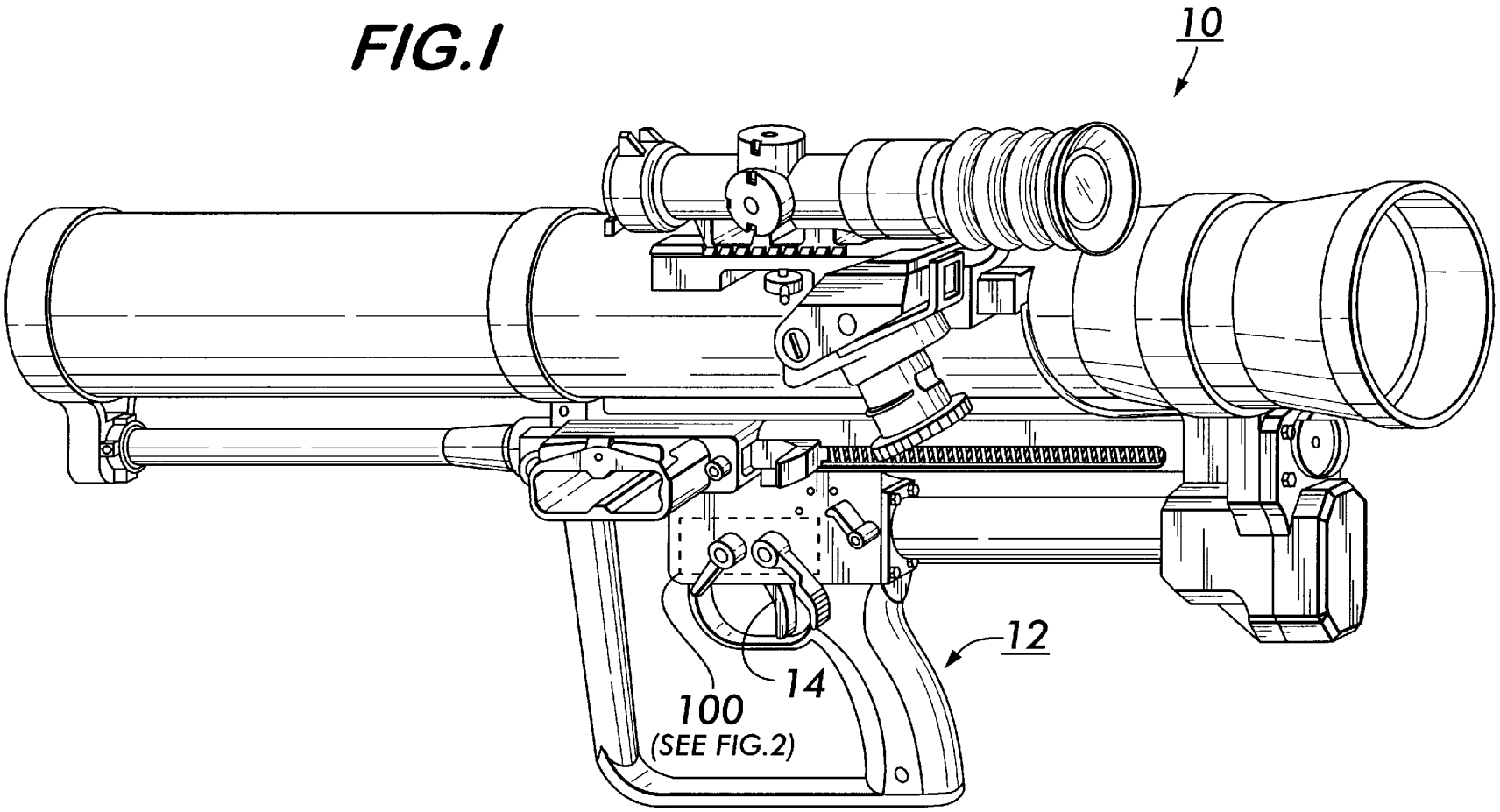
FIG. 1 is an overall view of the trigger mechanism of the present invention shown mounted on a typical rocket launcher assembly.

Referring to the drawings, wherein the same reference number indicates the same element throughout, there is shown in FIG. 1 an overall view of a typical launcher/spotter rifle assembly designated generally by the reference number 10. The rocket launcher/spotter rifle assembly 10 has a handle 12 that is used to operate a trigger 14 whose triggering action is controlled by the assembly 100 (shown in phantom) of the present invention which may be further described with reference to FIG. 2.

The assembly 100 comprises a housing 102 and a switch activator 104. The switch activator 104 is lodged in the housing 102 and has first and second ends 106 and 108 with an extension 110 extending outward from the first end 108. The switch activator 104 also has an interior 112 that completely extends therethrough.

The assembly 100 further comprises first and second yielding means 114 and 116 respectively located adjacent the first end 106 and the second end 108. The first yielding means 114 has a first predetermined stiffness and the second yielding means 116 has a second predetermined stiffness which is less than the first stiffness. The spring constant for yielding means 116 may be approximately 15 lb/in. The spring constant of yielding means 114 may be approximately 100 lb/in.

The assembly 100 further comprises a rod 118 having at least first and second sections 120 and 122 with the first section 120 having a diameter that allows it to pass through the interior 112 of the sliding actuator 104. The second section 122 has a leading edge 122A that comes into contact with the first yielding means 114. The second section 122 of rod 118 enters and snugly occupies an opening 124 of the housing 102.

The assembly 100 further comprises a block 126 mated to the housing 102 by appropriate means. Screws 128 and 130 hold switch 132 to block 126. Block 126 is mated to housing 102 by the geometry of the block and housing (ie: keys and keyways cut into parts) and screw 140. The block 126 has attached thereto by appropriate means (not shown) a depressible switch assembly 132 which may have an arm 134 that is located in alignment with the extension 110 of the sliding actuator 104.

Figure 2:
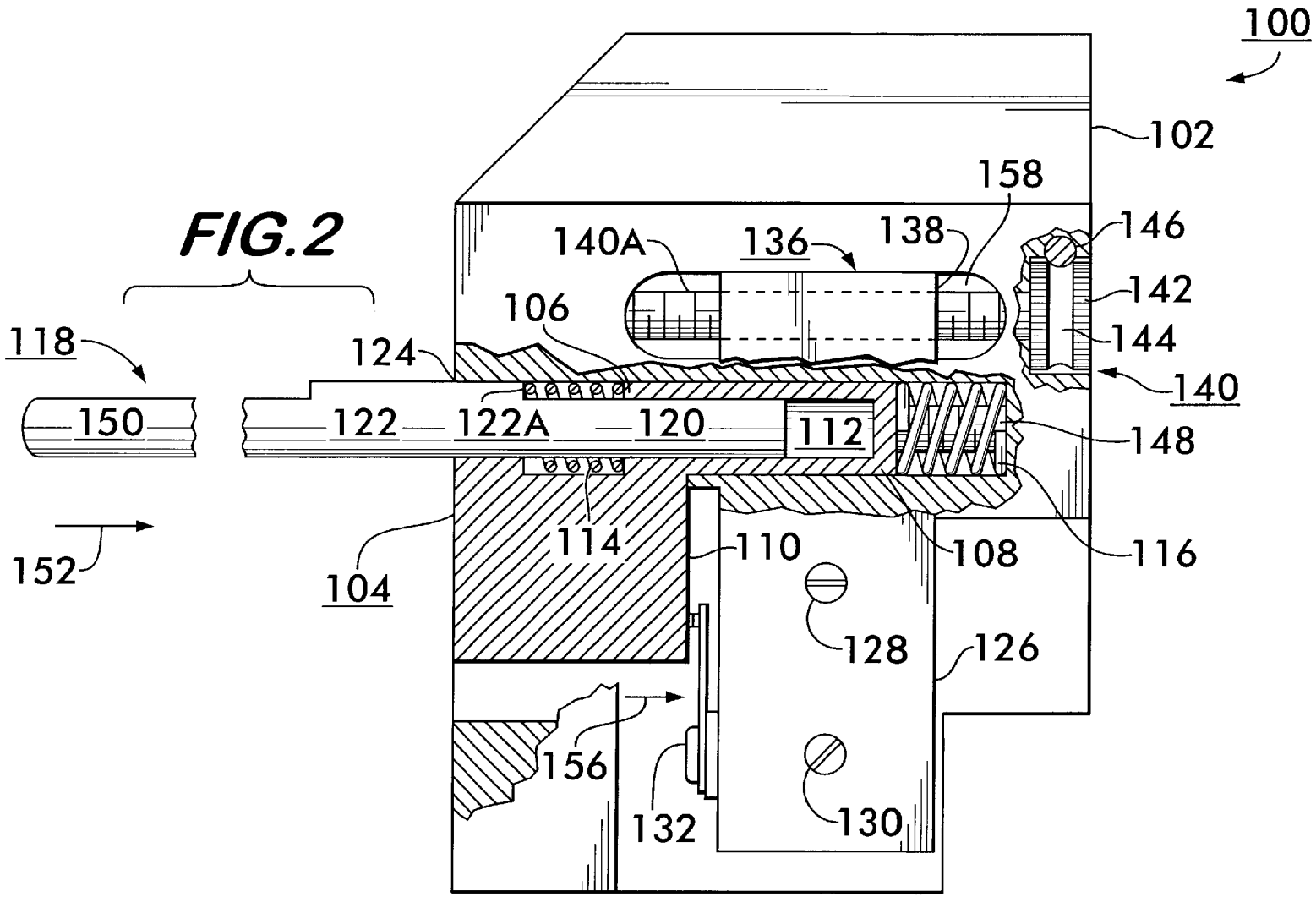
FIG. 2 illustrates the assembly of the present invention for a trigger mechanism and is partially cut-away so as to more clearly show the arrangement of the associated elements thereof.

The block 126 is preferably slidably adjusted by adjustment means 136 shown in the upper portion of block 126 as viewed in FIG. 2. The adjustment means 136 comprises a threaded opening 138 of the block 126 and a screw 140 having a head 142 and threads 140A which are complementary to the internal threads on the opening 138 of the block 126. The head 142 preferably has a groove 144 into which is lodged a spring pin 146.

The housing 102 has a hollow comprising a sequentially arranged first, second and third compartments that respectively provide for the lodging therein of the first yielding means 114, first and second ends 106 and 108 of the switch actuator 104 as well as the extension 110 of the slidable actuator 104, and the second yielding means 116. The third compartment that lodges the second yielding means 118 further comprises an opening in the third compartment and which is dimensioned to accept a set screw 148 which, in turn, is dimensioned to pass through the predetermined opening of the second yielding means 116. The set screw 148 is adjustable by an opening (not shown) in the block 102 so as to come into contact with the second end 108 of the switch actuator 104. The set screw serves as a stop for the sliding actuator 104. The set screw 148 comes into contact with the second end 108 of the sliding actuator 104.

The first and second yielding means 114 and 116 are dimensioned so as to respectively operate within the first and second compartments of the housing 102. The first yielding means 114 has a predetermined opening that is sufficient to accept the first section 120 of the rod 118, whereas the second yielding means 116 has a second predetermined opening that is sufficient to accept the set screw 148.

The switch actuator 104 is dimensioned so that its first and second ends 106 and 108 completely occupy the second compartment of housing 102. The interior 112 of the sliding actuator 104 has a linear length which is sufficient to accept the complete length of the section 120 of the rod 118 when the first yielding means 114 is in its completely compressed state.

The rod 118 is selected so that its first section 120 has a diameter which is dimensioned so as to pass through the predetermined opening of the first yielding means 114. The second section 122 of rod 118 is dimensioned, in particular, to have a leading edge 122A that engages the first yielding means 114. The rod 118 preferably has a third section 150 that has a diameter similar to that of the first section 120 and has a length sufficient to interconnect to a cam which is tied to the launcher trigger mechanism 14 of FIG. 1.

Operation of the Switch Assembly

With reference to FIG. 2, in operation, the rod 118 is pushed in the direction 152 by way of the cam movement of the launcher trigger 14. The movement of the rod 118 in direction 152 causes the leading edge 122A to intercept the first yielding means 114 which, in turn, pushes against the first end 106 of the sliding activator 104 causing the first end 106 and the second end 108 to move in a direction 154, while also causing the extension 110 to move in a direction 156 shown in FIG. 2.

The switch activator 104 and the rod 118 move in unision due to the high stiffness of the first yielding means 114 which serves as an override spring. The switch activator 104, in particular, its extension 110 intercepts the arm 134 of the switch assembly 132 which, in turn, causes the triggering action of the switch assembly 132. After such triggering action, the second end 108 of the switch activator 104 intercepts the set screw 148 which prevents the switch activator 104, in particular, its outward extension from crushing the switch 132. The rod 118 however, is allowed to continue moving through the interior 112 of the switch activator 104 and it compresses the second yielding means 114. Screw 148 prevents end 108 from compressing 116, but only after switch has been activated. When the launcher trigger 14 is released, the switch activator 104, the first yielding means 114 serving as an override spring, and the switch rod 118 are returned to their original home positions by the resiliency of the second yielding means 116 serving as a recoil spring.

The switch assembly 132 can be adjusted to trigger within a range of about 0.4" within an accuracy of about 0.01 inches of horizontal travel by means of the adjustment screw 140 and the set screw 148. The adjustment screw 140 preferably fits through a hole 158 in the block 126 and is threaded into the opening 138 of the block 126. The pin 146 captures the adjustment screw 142 while allowing the adjustment screw 142 to turn about its axis which, in turn, allows the switch assembly 132 carried by the block 126 to be moved back and forth until the switch assembly 132 is properly adjusted in position relative to extension 110 and within a range of 0.012–0.04 for the separation between the switch activator 104 and the arm 134 of the switch assembly 132. The set screw 148 is adjusted such that the switch tab 104 moves only enough to trigger the switch assembly 132.

It should now be appreciated that the practice of the present invention provides for a switch assembly that allows for an adjustable linear travel of its associated trigger mechanism of about 0.41" and such adjustment is within an accuracy of about 0.01 inches. Further, it should be appreciated that the practice of the present invention prevents any damage to the switch assembly of the launcher mechanism from any over-travel of the trigger mechanism.

Although the invention has been described relative to a specific embodiments thereof, there are numerous variations and modifications that will be readily apparent to those skilled in the art in light of the above teachings. It is, therefore, to be understood that, within the scope of the appended claims, the invention may be practiced other than as specifically described.

What we claim is:

1. An assembly interconnected to the triggering mechanism of a firearm and controlling the trigger action of the triggering mechanism, said assembly comprising:

(a) a housing;

(b) a sliding actuator with an interior and being lodged in said housing and having first and second ends with an extension extending outward from said first end;

(c) a first yielding means having a first predetermined stiffness and lodged in said housing and located around adjacent said first end of said sliding actuator;

(d) a second yielding means having a second predetermined stiffness which is less than said first predetermined stiffness and lodged in said housing and located adjacent said second end of said sliding actuator;

(e) a rod having at least first and second sections having respective diameters to pass through said interior of said sliding actuator and to come into contact with said first yielding means;

(f) a block mated to said housing and located adjacent said extension of said sliding actuator; and (g) a depressible switch located on said block and in alignment with said extension of said sliding actuator, said depressible switch being separated from said extension by a distance in the range from 0.012 inches to 0.04 inches so as to limit over travel of said extension contacting said depressible switch.

2. The switch control assembly according to claim 1, wherein said housing further comprises a first opening having a diameter sufficient to accept the diameter of said second section of said rod.

3. The switch control assembly according to claim 1, wherein said second section of said rod leads into said first section of said rod and, wherein said rod further comprises a third section that leads into said second section.

4. The switch control assembly according to claim 1, wherein said second end of said sliding actuator abuts against said second yielding means.

5. The switch control assembly according to claim 1, wherein said housing has a second opening leading into a third compartment and is dimensioned to accept a set screw which is dimensioned to pass through said second yielding means, said set screw being adjustable to come into contact with second end of said sliding actuator and set the position of a spring.

6. An assembly interconnected to the triggering mechanism of a firearm and controlling the trigger action of the triggering mechanism, said assembly comprising:

(a) a housing;

(b) a sliding actuator with an interior and being lodged in said housing and having first and second ends with an extension extending outward from said first end;

(c) a first yielding means having a first predetermined stiffness and lodged in said housing and located around adjacent said first end of said sliding actuator;

(d) a second yielding means having a second predetermined stiffness which is less than said first predetermined stiffness and lodged in said housing and located adjacent said second end of said sliding actuator;

(e) a rod having at least first and second sections having respective diameters to pass through said interior of said sliding actuator and to come into contact with said first yielding means;

(f) a block mated to said housing and located adjacent said extension of said sliding actuator, said block having means for slidably adjusting its location relative to said extension of said sliding activator which, in turn, adjusts the separation of said extension from a depressible switch; and (g) a depressible switch located on said block and in alignment with said extension of said sliding actuator.

7. A switch control assembly comprising:

(a) a housing having a hollow with sequentially arranged first, second and third compartments, said second compartment having an opening along its side that abuts against said first compartment;

(b) first and second yielding means with the first yielding means having a stiffness which is greater than the stiffness of the second yielding means, said first yielding means having a first predetermined opening and dimensioned so as to occupy said first compartment, and said second yielding means having a second predetermined opening and dimensioned so as to occupy said third compartment;

(c) a sliding actuator that has a first portion that is dimensioned to occupy said second compartment and having a first predetermined inner diameter and a first predetermined length, said first portion having first and second ends with the first end abutting against said first yielding means and the second end abutting against said second yielding means, said sliding actuator having a second portion that extends outward from the second compartment by a predetermined amount;

(d) a rod having at least first and second sections with the first section having a diameter dimensioned to pass through both said first predetermined opening of said first yielding means and said first predetermined inner diameter of said sliding actuator, said second section of said rod having a diameter dimensioned to engage said first yielding means, said first section being insertable into and occupying all of said first compartment and some but not all of said second compartment;

(e) a block mated to said housing and located adjacent said second portion of said sliding actuator; and (f) a depressible switch located on said block and in alignment with and separated from said second portion of said sliding actuator by a predetermined distance.

8. The switch control assembly according to claim 7, wherein said housing further comprises a first opening having a diameter sufficient to accept the diameter of said second section of said rod and, wherein said first compartment has an entrance for accepting said first section of said rod and, wherein said first opening is located before said entrance of said first compartment.

9. The switch control assembly according to claim 8, wherein the second section of said rod leads into said first section of said rod that enters said first compartment and, wherein said rod further comprises a third section that leads into said second section.

10. The switch control assembly according to claim 7, wherein said second end of said first portion of said sliding actuator which abuts against said second yielding means.

11. The switch control assembly according to claim 10, wherein said housing has a second opening leading into said third compartment and is dimensioned to accept a set screw which is dimensioned to pass through said second predetermined opening of said second yielding means, said set screw being adjustable to come into contact with the second end of said sliding actuator.

12. The switch control assembly according to claim 7, wherein said block has means for slidably adjusting its location relative to said second portion of said sliding actuator which, in turn, adjusts the predetermined distance of said separation of said second portion from said depressible switch.

13. The switch control assembly according to claim 12, wherein said means for slidably adjusting the location comprises:

(a) a threaded opening in said block;

(b) a screw having a head and a shaft threaded in a complementary manner relative to said threaded opening of said block and with said head having a groove; and (c) a spring dimensioned to fit into said groove of said head.

14. The switch control assembly according to claim 6, wherein said housing further comprises a first opening having a diameter sufficient to accept the diameter of said second section of said rod.

15. The switch control assembly according to claim 6, wherein said second section of said rod leads into said first section of said rod and, wherein said rod further comprises a third section that leads into said second section.

16. The switch control assembly according to claim 6, wherein said second end of said sliding actuator abuts against said second yielding means.

17. The switch control assembly according to claim 6, wherein said housing has a second opening leading into a third compartment and is dimensioned to accept a set screw which is dimensioned to pass through said second yielding means, said set screw being adjustable to come into contact with second end of said sliding actuator and set the position of a spring.

* * * * *